US010066449B2

(12) United States Patent
Wheater et al.

(10) Patent No.: US 10,066,449 B2
(45) Date of Patent: Sep. 4, 2018

(54) LOW FRICTION WIRELINE STANDOFF

(71) Applicants: Guy Wheater, Scarborough (GB); Stuart Huyton, Elgin (GB)

(72) Inventors: Guy Wheater, Scarborough (GB); Stuart Huyton, Elgin (GB)

( * ) Notice: Subject to any disclaimer, the term of this patent is extended or adjusted under 35 U.S.C. 154(b) by 0 days.

(21) Appl. No.: 14/959,525

(22) Filed: Dec. 4, 2015

(65) Prior Publication Data

US 2016/0108684 A1 Apr. 21, 2016

Related U.S. Application Data

(63) Continuation of application No. 12/871,218, filed on Aug. 30, 2010, now Pat. No. 9,234,394.

(30) Foreign Application Priority Data

Aug. 7, 2010 (GB) ..... 1013292.6

(51) Int. Cl.
*E21B 17/10* (2006.01)

(52) U.S. Cl.
CPC ..... *E21B 17/10* (2013.01); *E21B 17/1057* (2013.01)

(58) Field of Classification Search
CPC ..... E21B 17/10; E21B 17/1057; E21B 19/24; E21B 17/1014; E21B 17/1064; E21B 43/106
See application file for complete search history.

(56) References Cited

U.S. PATENT DOCUMENTS 484,947 A * 10/1892 Black ..... E21B 17/1057 166/241.3
712,901 A * 11/1902 Black ..... E21B 17/1057 166/241.4
1,913,365 A * 6/1933 Bailey ..... E21B 17/1057 175/325.3
2,960,709 A * 11/1960 Peaker ..... B08B 9/0436 15/104.15
3,125,382 A 3/1964 Herndon, Jr. et al.
(Continued)

FOREIGN PATENT DOCUMENTS

CA 1062154 9/1979
GB 2393984 A 4/2004
GB 2450918 A 1/2009

OTHER PUBLICATIONS

UK Intellectual Property Office Search Report for Application No. GB13550.2 dated Mar. 12, 2008.
(Continued)

*Primary Examiner* — Kipp C Wallace
(74) *Attorney, Agent, or Firm* — Tumey L.L.P.

(57) ABSTRACT

The low friction wireline standoff improves wireline cable performance during borehole logging operations. The use of low friction wireline standoffs ameliorates the effects of wireline cable differential sticking, wireline cable key-seating, and high wireline cable drags, by reducing or eliminating contact of the wireline cable with the borehole wall during the logging operation. The low friction wireline standoff comprises external wheels mounted on two finned half shells that clamp onto the wireline with precision cable inserts which are manufactured to fit a wide range of logging cables. The wheels reduce the cable drag down-hole resulting in lower surface logging tensions, aiding conveyance in deep and deviated wells.

17 Claims, 5 Drawing Sheets

(56) References Cited

U.S. PATENT DOCUMENTS 3,545,825 A * 12/1970 Hamilton ..... E21B 17/1057 175/325.4
3,692,109 A 9/1972 Grayson
3,939,570 A * 2/1976 Loftus ..... E21B 47/08 33/544.3
4,187,919 A * 2/1980 Lambot ..... E21B 25/02 175/246
4,372,622 A 2/1983 Cheek
4,431,963 A * 2/1984 Walkow ..... C23F 13/04 204/404
4,804,906 A * 2/1989 Hamberg ..... G01R 27/14 324/347
5,522,467 A * 6/1996 Stevens ..... E21B 17/1057 175/325.3
5,692,562 A * 12/1997 Squires ..... E21B 17/1071 166/241.3
5,692,563 A * 12/1997 Krueger ..... E21B 17/1014 166/241.6
6,209,667 B1 4/2001 Murray et al.
6,250,394 B1 6/2001 Mashburn
6,250,406 B1 6/2001 Luke
6,260,617 B1 7/2001 Baugh et al.
6,382,333 B1 5/2002 Murray
6,684,965 B1 * 2/2004 Bakke ..... E21B 17/1057 166/241.3
6,779,598 B2 * 8/2004 Hall ..... E21B 4/18 166/104
7,048,064 B1 5/2006 Smith
7,144,243 B2 * 12/2006 Stephenson ..... B21D 39/08 425/387.1
7,188,689 B2 3/2007 Maxwell et al.
7,395,881 B2 7/2008 McKay et al.
7,403,000 B2 7/2008 Barolak et al.
7,866,384 B2 1/2011 Hall
8,245,779 B2 8/2012 Lemke et al.
8,733,455 B2 5/2014 Shaikh et al.
8,919,436 B2 12/2014 Wheater et al.
9,234,394 B2 * 1/2016 Wheater ..... E21B 17/10
2001/0020530 A1 9/2001 Eaton
2002/0020526 A1 * 2/2002 Male ..... E21B 17/1057 166/241.6
2003/0106696 A1 * 6/2003 Lauritzen ..... E21B 29/005 166/380
2005/0098353 A1 * 5/2005 Maxwell ..... E21B 17/1057 175/57
2005/0252655 A1 11/2005 McKay et al.
2012/0018145 A1 1/2012 Wheater et al.
2012/0255744 A1 10/2012 Shaikh et al.
2013/0248206 A1 9/2013 Jordan et al.

OTHER PUBLICATIONS

USPTO Office Action for U.S. Appl. No. 12/871,218 dated Dec. 17, 2014.
USPTO Office Action for U.S. Appl. No. 12/871,218 dated Oct. 23, 2013.
USPTO Office Action for U.S. Appl. No. 12/871,218 dated May 21, 2012.
USPTO Final Office Action for U.S. Appl. No. 12/871,218 dated Apr. 6, 2015.
USPTO Final Office Action for U.S. Appl. No. 12/871,218 dated Mar. 24, 2014.
USPTO Final Office Action for U.S. Appl. No. 12/871,218 dated Aug. 30, 2012.
USPTO Notice of Allowance for U.S. Appl. No. 12/871,218 dated Sep. 4, 2015.

* cited by examiner

LOW FRICTION WIRELINE STANDOFF

CROSS-REFERENCE TO RELATED APPLICATIONS

The present application is a continuation of U.S. application Ser. No. 12/871,218 filed Aug. 30, 2010 that claims priority to United Kingdom Patent Application No. GB1013292.6, entitled "Low Friction Wireline Standoff," filed on Aug. 7, 2010, the entire disclosure of each are incorporated herein by reference in their entirety.

BACKGROUND

This invention relates to a device that improves wireline cable performance during logging operations in a variety of boreholes. The use of low friction wireline standoffs ameliorates the effects of wireline cable differential sticking, wireline cable key-seating, and high cable drags by reducing or eliminating the contact of the wireline cable with the borehole wall during the logging operation.

Wireline logging is a common operation in the oil industry whereby down-hole electrical tools are conveyed on wireline (also known as "e-line" in industry parlance) to evaluate formation lithologies and fluid types in a variety of boreholes. In certain wells there is a risk of the wireline cable and/or logging tools becoming stuck in the open hole due to differential sticking or key-seating, as explained below.

Key-seating happens when the wireline cable cuts a groove into the borehole wall. This can happen in deviated or directional wells where the wireline cable may exert considerable sideways pressure at the contact points with the borehole. Since the logging tool diameter is generally much bigger than the groove cut by the wireline cable a keyseat can terminate normal ascent out of the borehole and result in a fishing job or lost tools in hole.

Differential sticking can occur when there is an overbalance between hydrostatic and formation pressures in the borehole; the severity of differential sticking is related to:

- The degree of overbalance and the presence of any depleted zones in the borehole.
- The character and permeability of the formations bisected by the borehole.
- The deviation of the borehole, since the sideways component of the tool weight adds to the sticking forces.
- The drilling mud properties in the borehole, since the rapid formation of thick mud cakes can trap logging tools and the wireline cable against the borehole wall.
- The geometry of toolstring being logged on wireline. A long and large toolstring presents a larger cross sectional area and results in proportionally larger sticking forces.

Additionally, during wireline formation sampling, the logging tools and wireline may remain stationary over permeable zones for a long period of time which also increases the likelihood of differential sticking.

SUMMARY

This invention ameliorates the effects of differential sticking and key-seating of the wireline cable by reducing or eliminating direct contact of the cable to the borehole wall. This is achieved by clamping an array of low friction wireline standoffs onto the wireline cable, resulting in a lower contact area per unit length of open hole, lower applied sideways pressure of the wireline against the borehole wall, and lower cable drag when conveying the wireline in or out of the hole. The use of low area standoffs also enables more efficient use of wireline jars in the logging string since they reduce the cable friction above the jars, allowing firing at lower surface tensions and easier re-rocking of the jars in boreholes where high cable drag is a problem (absorbing the applied surface tension before it can reach the wireline cable head and jars).

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of the present invention and should not be used to limit or define the invention.

FIG. 3*a* shows an example close up view of the low friction wireline standoff on the wireline cable in relation to the borehole wall.

DETAILED DESCRIPTION

Figure 1:
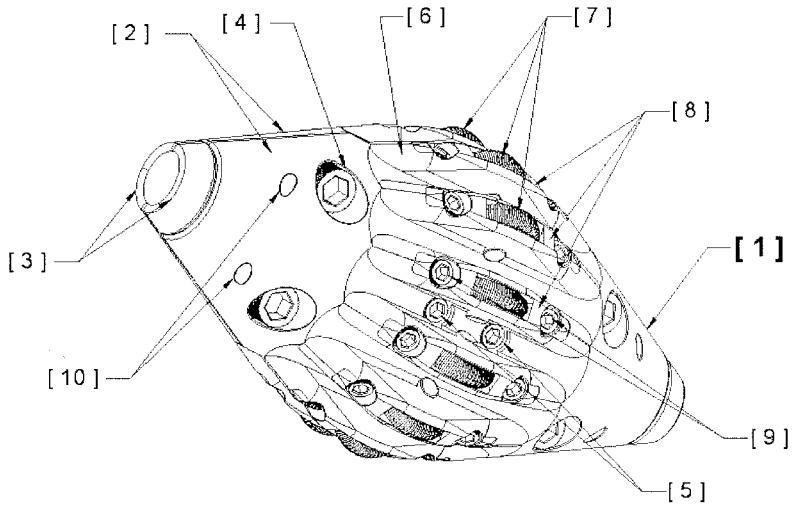
FIG. 1 is an isometric view of the wireline standoff before being clamped onto the wireline.

An array of low friction wireline standoffs can be installed on the wireline cable to minimize the wireline cable contact over a selected zone(s) of the open hole section. The low friction wireline standoffs may be installed on the wireline cable to either straddle known permeable zones where differential sticking is a risk (e.g., eliminating cable contact 100%) or they can be placed at regular intervals along the wireline cable to minimize keyseating, taking into account the dog leg severity of the borehole. The higher the dogleg severity the shorter the recommended spacing between wireline standoffs installed on the wireline cable. The spacing of wireline standoffs on the cable may be from 10's of feet to 100's of feet, depending on the requirements for the particular borehole being logged.

In accordance with present embodiments, each low friction wireline standoff comprises two opposing assemblies which mate together onto the wireline cable. In an embodiment, the opposing assemblies clamp together on the wireline cable with four cap head bolts. The assemblies comprise two stainless steel half shells with exterior wheels and two disposable cable inserts on the interior. In one embodiment, the assemblies comprise twelve exterior wheels. In an exemplary embodiment, contact with the wireline cable exterior is solely with the cable inserts made from aluminum, and not the stainless steel half shells. In one embodiment, the cable inserts are designed to slightly deform around the outer wireline cable armour during installation without physically damaging the wireline cable. There are a large range of cable inserts available to fit the wireline cable, taking into account any manufacturing tolerances and varying degrees of wear or distortion along the length of the wireline cable. Therefore, for an array of low area standoffs installed on the wireline cable a range of different cable inserts may be employed to ensure a fit which does not allow slippage along the wireline cable or damage to the wireline cable when clamped. The four cap head bolts that clamp the two assemblies together are torqued to a consistently safe limit with a calibrated torque wrench.

In certain embodiments, the stainless steel half shells are vacuum hardened for improved wear resistance during use and a range of shell sizes are available for installation on the wireline, for example, from 50 mm O.D. upwards. The aluminum cable inserts are positively secured into each stainless half shell by small cap head bolts that pass through the outside of each half shell into tapped holes in the cable insert bodies. The cable inserts have zero freedom of movement inside the half shells because:

a) a central spigot eliminates rotation of the cable inserts in the half shells.

b) a central flange on the cable inserts ensures no axial movement in the half shells.

The low friction wireline standoff may further include a plurality of fins along its length. In an embodiment, the low friction wireline standoff has 12 fins cut along its length, each fin holding a wheel sub assembly. The wheels rotate in plain bearings machined in the bodies of the half shells and are clamped in position with slotted wheel retainers and cap head bolts. The wheels reduce the standoff rolling resistance which results in lower tensions and cable drags inside casing and the open borehole.

The wheels also minimize contact area of the standoff assemblies with the borehole wall and reduce the differential sticking force acted upon each wheel at the contact points with the borehole. They also allow easy rotation of the standoffs if the wireline cable rotates when it is deployed and retrieved from the borehole. Note that it is the general nature of wireline logging cable to rotate during logging operations due to the opposing lay angles of the inner and outer armours which can induce unequal torsional forces when tensions are applied. The design of the shells and wheels allows easy rotation of the wireline cable during the logging operation, avoiding the potential for damage if excessive torque was allowed to build up.

In addition, the low friction wireline standoff may further include a plurality of holes in the half shells for use in installation. In an embodiment, four holes in the standoff half shells are used to connect a lanyard during installation, to avoid dropped objects on the drill floor during installation on the wireline cable.

In accordance with certain embodiments, the maximum external diameter of the low friction wireline standoff is less than the size of overshot and drill pipe i.d. during fishing operations. In the event of a fishing job, the array of low area standoffs will safely fit inside the fishing assembly provided by the Operator, enabling the wireline cable head or tool body to be successfully engaged by the fishing overshot. The wireline cable and low friction wireline standoff array may then be safely pulled through the drill pipe all the way to surface when the cable head is released from the logging string.

The invention will now be described in detail with the aid of FIGS. 1-8, as summarized below. Note that "low friction wireline standoff" implies the full assembly of aforementioned components i.e. the stainless steel half shells and wheel sub assemblies, the aluminum cable inserts, and the associated cap head bolts.

The low friction wireline standoff 1 as seen in FIG. 1 comprises twelve exterior wheels mounted in two stainless steel half shells 2 and two internal aluminum cable inserts 3 which clamp directly onto the wireline cable using four cap head bolts 4. The cable inserts are secured in their half shells by two fully recessed small cap head bolts 5. Twelve external fins 6 and wheel sub assemblies on the low friction wireline standoff aid easy passage along the borehole and casing in the well. Each fin 6 supports a wheel sub assembly comprising a high strength wheel and axle 7, and a slotted wheel retainer 8, secured by a pair of cap head bolts 9. Each wheel is profiled for axial grip whilst minimizing the rolling resistance and contact area with the borehole, and also allowing for standoff rotation under the action of cable torque. The empty space between the fins and wheel sub assemblies allow for circulation of drilling mud inside drill pipe if the wireline cable and standoff assembly are fished using drill pipe. Holes across the two half shells 10 permit the fitting of a lanyard to avoid dropping them during their installation onto the wireline cable on the drill floor.

Figure 2:
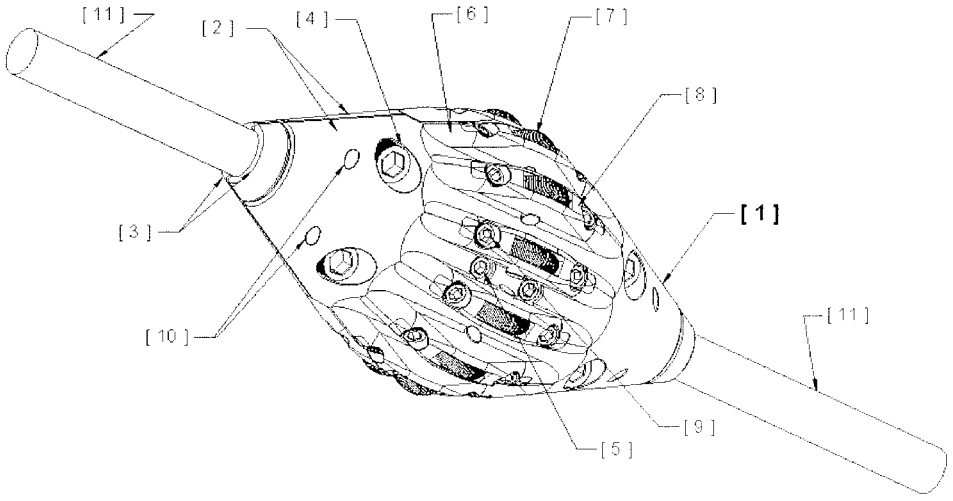
FIG. 2 is an isometric view of the low friction wireline standoff clamped onto a short section of wireline.

As depicted in FIG. 2, a short section of the wireline cable 11 passes through the central bore of the cable inserts 3 in the low friction wireline standoff 1. The wireline cable diameter may vary between 10-15 mm, depending on the logging vendor. The cable inserts are carefully matched to the diameter of the wireline cable regardless of any variations in size or profile that might occur along the length of the wireline cable. The cable inserts can be made from aluminum which is considerably softer than the armour material of the wireline cable. An accurate fit of the cable inserts on the wireline cable and the controlled torque of the four cap head bolts 4 during installation ensures that the cable inserts cannot damage the wireline cable when the bolts are tightened, pulling the two half shells 2 together.

Figure 3:
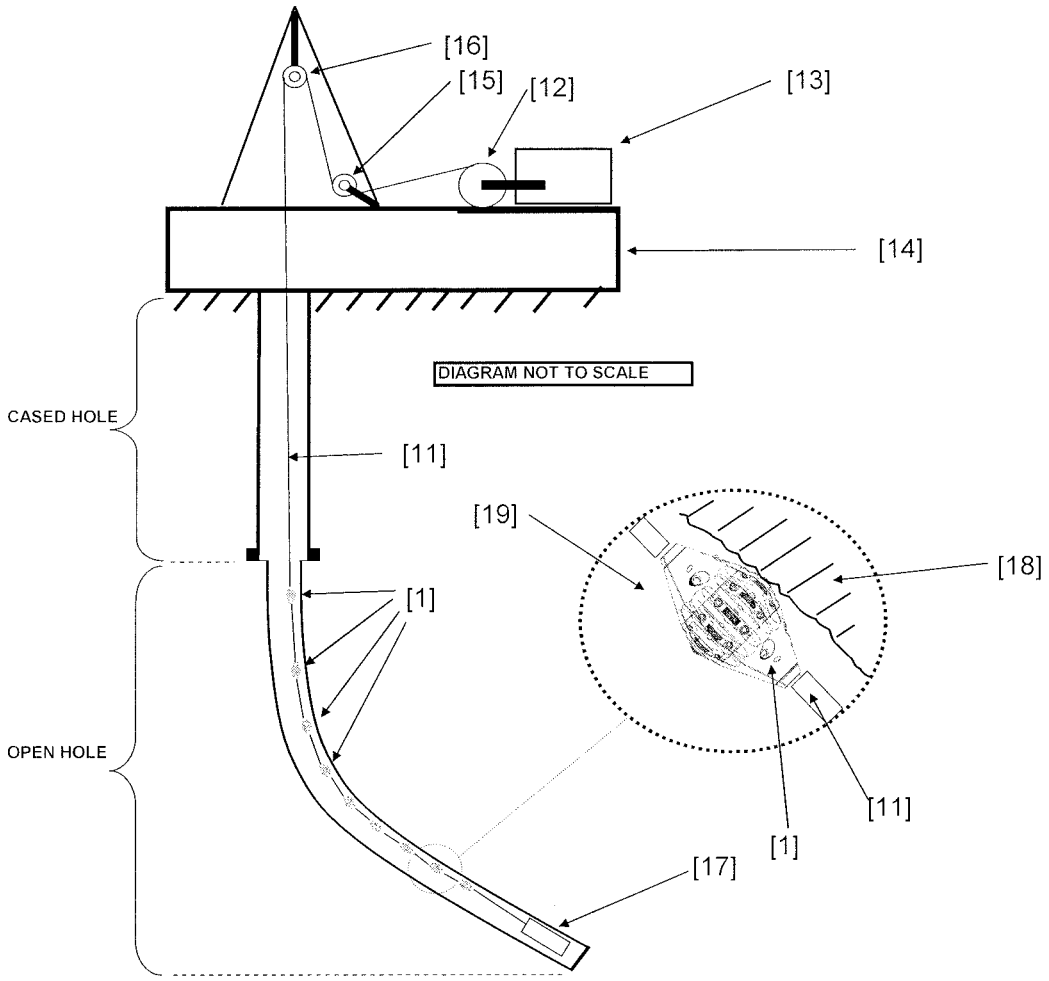
FIG. 3 illustrates an array of low friction wireline standoffs installed on a wireline cable in the borehole during borehole logging operations.

FIG. 3 shows a generic logging operation and low friction wireline standoff deployment. An array of low friction wireline standoffs 1 is clamped onto the wireline cable 11 which is stored on the wireline drum 12 and spooled into the well by a winch driver and logging engineer in the logging unit 13. The logging unit is fixed firmly to the drilling rig or platform 14 and the wireline is deployed through the derrick via two or three sheaves 15 and 16 to the maximum depth of the well. The logging tool connected to the end of the wireline cable 17 takes the petro-physical measurements or fluid or rock samples in the open hole section. The number of standoffs and their positions on the wireline are determined by the length of the open hole section, the location of sticky, permeable, or depleted zones, and the overall trajectory of the well, which may be deviated or directional in nature. As per the close up illustration in FIG. 3*a* the low friction wireline standoff 1 can be seen in relation to the wireline cable 11 and the borehole wall 18 and the borehole 19.

Figure 4:
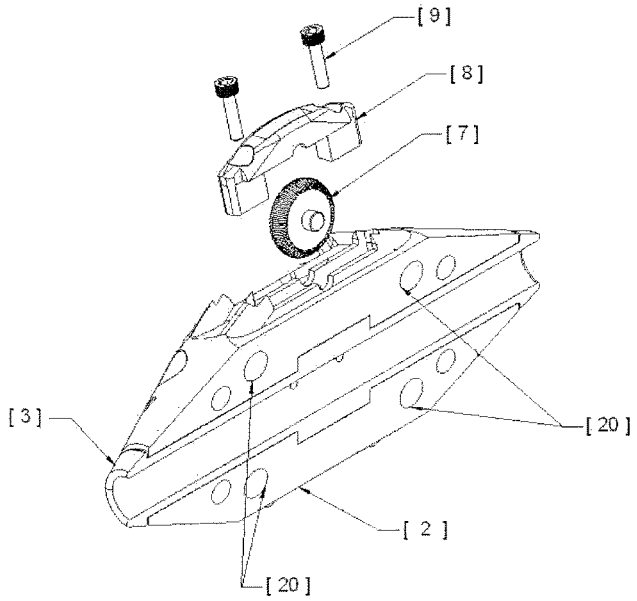
FIG. 4 is an isometric exploded view of the low friction wireline standoff with a single wheel sub assembly and one half shell removed, to illustrate the fitting of the aluminum cable insert.
Figure 4A:
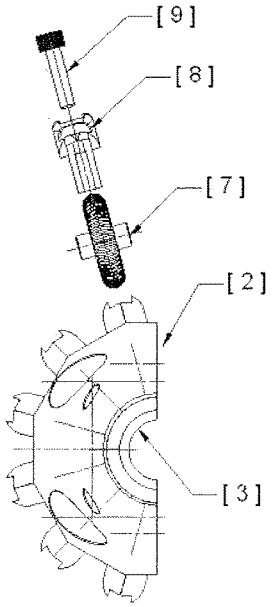
FIG. 4*a* is an end view of the same components in FIG. 4.

FIGS. 4 and 4*a* show the low friction wireline standoff with the lower half shell 2 removed such that the upper half shell 2 with cable insert in-situ 3 can be viewed. Included is a semi-exploded view of a single wheel sub assembly that illustrates the wheel and axle 7 and slotted wheel retainer 8, with pair of cap head bolts 9 to hold them in the half shell 2. In FIG. 4 the four holes 20 in the upper half shell 2 allow accurate mating to the lower half shell via high strength dowel pins, eliminating any shear stress on the four cap head bolts that clamp the shells onto the wireline.

Figure 5:
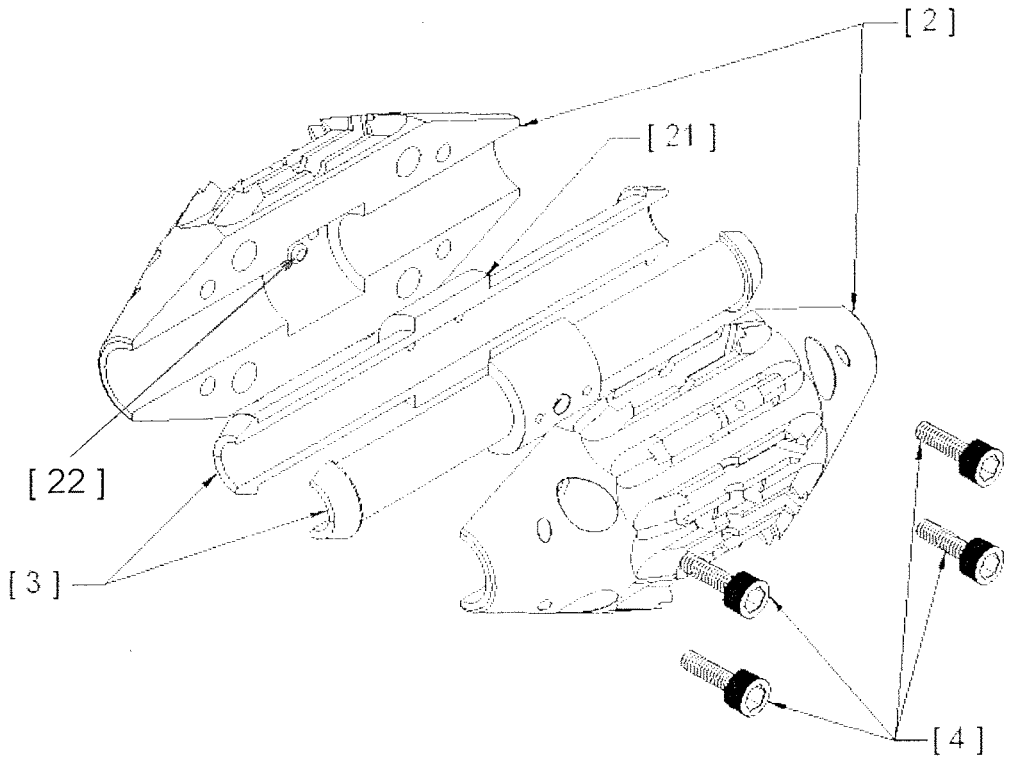
FIG. 5 is an exploded view of the half shells and cable inserts that make up each low friction wireline standoff assembly. The 12 wheel sub assemblies have been omitted for the sake of clarity.

FIG. 5 shows an exploded view of the low friction wireline standoff with the main components exposed: half shells 2, cable inserts 3, and four clamping bolts 4. The twelve wheel sub assemblies are not included for the sake of clarity. The cable insert flange 21 and anti-rotation spigot 22 eliminate any relative movement between the half shells and cable inserts.

Figure 6:
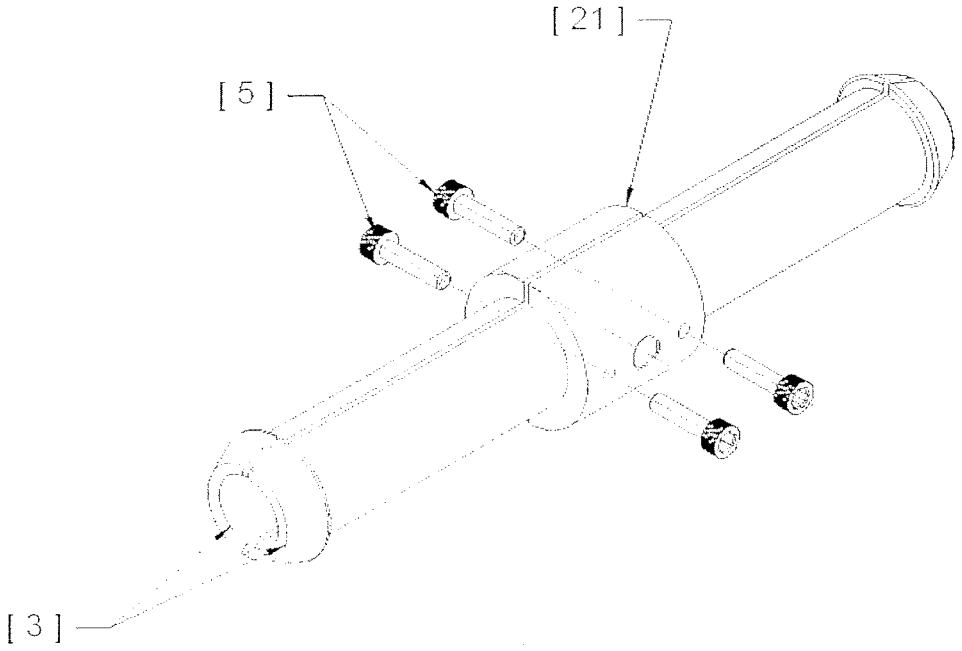
FIG. 6 illustrates the use of small cap head screws to hold the cable inserts inside the half shells.

FIG. 6 shows an exploded view of the cable inserts 3 with small cap head screws 5 that retain them in the half shells. The cable insert flange 21 and anti-rotation spigot 22 are clearly visible. The ends of the cable inserts are chamfered to avoid pinching the wireline cable.

Figure 7:
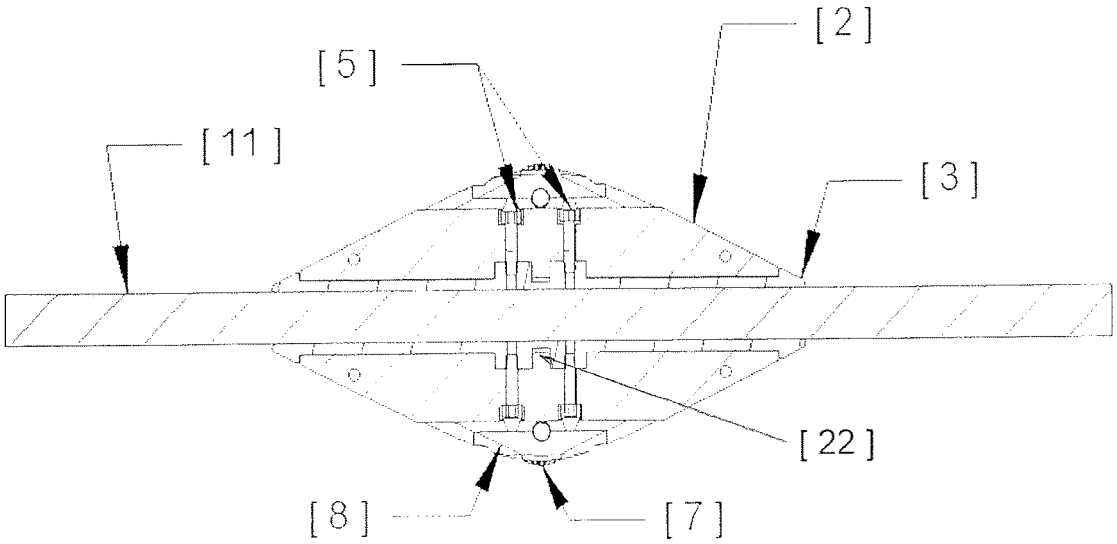
FIG. 7 illustrates a cross section of the half shell, cable inserts, cap head fixing screws and wireline cable.

FIG. 7 shows a cross section of the standoff installed on the wireline cable 11. It includes the cable insert 3 with small cap head screws 5 that retain them in the half shells 2. A partial view of the wheels 7 and wheel retainers 8 can also be seen in the cross section.

Figure 8:
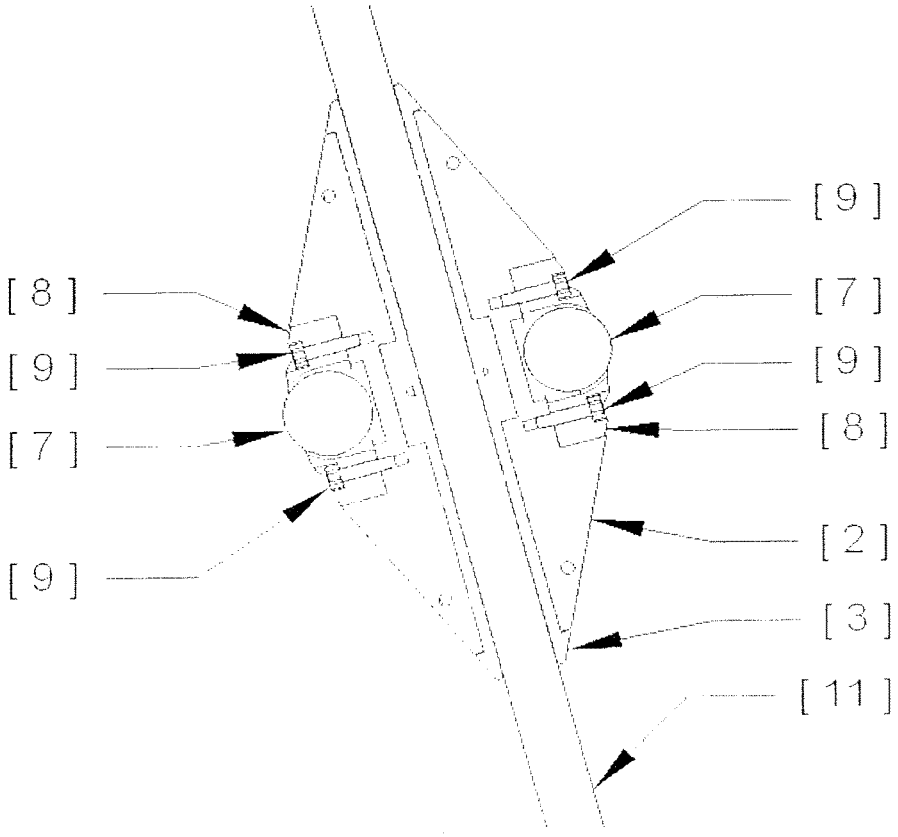
FIG. 8 illustrates a cross section of the low friction wireline standoff assembly in a plane bisecting two opposing wheel sub assemblies.

FIG. 8 shows a cross section of the low friction standoff installed on the wireline cable 11, in a plane which cuts through opposing wheel sub assemblies. It includes the half shell 2 and cable insert 3. The wheels and axles 7 are held in place with slotted wheel retainers 8 and cap head screws 9.

Although the present invention and its advantages have been described in detail, it should be understood that various changes, substitutions and alterations may be made herein without departing from the spirit and scope of the invention as defined by the appended claims.

What is claimed is:

1. A low friction wireline standoff, comprising:

adjacent opposing half shells, wherein each of the half shells comprise a plurality of holes, wherein a plurality of bolts are disposed through the plurality of holes disposed on each of the half shells and attach the half shells to each other, at least one wheel sub assembly disposed on each of the adjacent opposing half shells, wherein at least one wheel comprises an axle and is mounted within an axle housing, wherein the at least one wheel is inserted from the exterior into the at least one wheel sub assembly; and a slotted wheel retainer that covers at least a part of the at least one wheel in the wheel sub assembly, wherein the at least one wheel protrudes through a rectangular slot in the slotted wheel retainer, wherein the slotted wheel retainer is secured to the wheel sub assembly by bolts, and wherein the axle housing is formed by the slotted wheel retainer and the wheel sub assembly.

2. The low friction wireline standoff according to claim 1 wherein a cable insert is disposed in each half shell, wherein a cable insert flange is disposed on the cable insert, wherein the cable insert is configured for clamping onto a wire line cable.

3. The low friction wireline standoff according to claim 1 wherein the a cable insert comprises aluminum and is configured to deform slightly during installation onto the wireline.

4. The low friction wireline standoff according to claim 1 wherein the low friction wireline standoff has an axis, wherein the low friction wireline standoff is profiled along the axis with an angle of attack that supports smooth movement along a borehole and past any obstructions when running the wireline in or out of the borehole.

5. The low friction wireline standoff according to claim 1 wherein a plurality of external fins and the at least one wheel sub assembly have a smooth radial cross sectional area to minimize the external fin contact with a borehole wall and allow easy rotation as the low friction wireline standoff is deployed and retrieved from the borehole.

6. The low friction wireline standoff according to claim 1 wherein a plurality of external fins and the at least one wheel sub assembly allow the easy circulation of drilling mud past the standoff assembly during a fishing operation.

7. The low friction wireline standoff according to claim 1 wherein a maximum external diameter of the low friction wireline standoff is less than a size of overshot and drill pipe inner diameter during a fishing operation.

8. A low friction wireline standoff, comprising:

a first assembly comprising:

a first half shells;

a first set of sub assemblies disposed on the first half shell;

a first set of slotted wheel retainers that are removable from the first set of sub assemblies, wherein the first set of slotted wheel retainers comprises a rectangular slot, wherein the first set of slotted wheel retainers are secured to the first set of sub assemblies by bolts;

a second assembly comprising:

a second half shell;

a second set of sub assemblies disposed on the second half shell;

a second set of slotted wheel retainers that are removable from the second set of sub assemblies, wherein the second set of slotted wheel retainers comprises the rectangular slot, wherein the second set of slotted wheel retainers are secured to the second set of sub assemblies by bolts; and at least one wheel, wherein the at least one wheel protrudes through the rectangular slot in the first set of slotted wheel retainers and the rectangular slot in the second set of slotted wheel retainers, wherein the axle housing is forming by coupling the first set of slotted wheel retainers to the first set of sub assemblies or the second set of slotted wheel retainers to the second set of sub assemblies;

wherein the first assembly and the second assembly are configured to mate together.

9. The low friction wireline standoff according to claim 8 wherein an exterior portion of the first assembly and an exterior portion of the second assembly are profiled on their axes.

10. The low friction wireline standoff according to claim 8 wherein an anti-rotation spigot is mounted within the first half shell.

11. The low friction wireline standoff according to claim 8 wherein the low friction wireline standoff includes a total of twelve external fins cut along a length of the first assembly and the second assembly.

12. A wireline assembly comprising:

a wireline cable;

a low friction wireline standoff, wherein the low friction wireline standoff comprises:

adjacent opposing half shells;

at least one wheel, wherein the at least one wheel comprises an axle and is mounted within an axle housing, wherein the at least one wheel is inserted from the exterior into a wheel sub assembly;

a slotted wheel retainer that covers at least a part of the at least one wheel in the wheel sub assembly and wherein the axle housing is formed by the slotted wheel retainer and the wheel sub assembly; and wherein the wireline cable extends through the interior of the wireline standoff.

13. The wireline assembly according to claim 12 wherein the low friction wireline standoff comprises an axis, and wherein an exterior portion of the low friction wireline standoff is profiled along the axis.

14. The wireline assembly according to claim 12 wherein the opposing half shells comprise radially distributed external fins.

15. The wireline assembly according to claim 14 wherein the external fins each hold a wheel sub assembly, wherein each of the wheel sub assemblies comprise one of the at least one wheel.

16. The wireline assembly according to claim 12 wherein the low friction wireline standoff includes a total of twelve fins cut along a length of the opposing half shells, and wherein at least one wheel comprise a total of twelve wheels.

17. The wireline assembly according to claim 12, further comprising cable inserts, wherein the cable inserts are disposed in an interior of the wireline standoff, wherein the cable inserts attach to the wireline cable, wherein the cable inserts compromise aluminum.

* * * * *